US007621115B2

(12) United States Patent
Furukawa

(10) Patent No.: US 7,621,115 B2
(45) Date of Patent: Nov. 24, 2009

(54) HALL-TYPE ELECTRIC PROPULSION

(75) Inventor: Takeshi Furukawa, Tokyo (JP)

(73) Assignee: Japan Aerospace Exploration Agency, Tokyo (JP)

( * ) Notice: Subject to any disclaimer, the term of this patent is extended or adjusted under 35 U.S.C. 154(b) by 0 days.

(21) Appl. No.: 12/048,478

(22) Filed: Mar. 14, 2008

(65) Prior Publication Data

US 2008/0223017 A1 Sep. 18, 2008

(30) Foreign Application Priority Data

Mar. 14, 2007 (JP) ..... 2007-064551

(51) Int. Cl.
*F03H 1/00* (2006.01)
*B63H 11/00* (2006.01)

(52) U.S. Cl. ..... 60/202; 60/204

(58) Field of Classification Search ..... 60/202, 60/204

See application file for complete search history.

(56) References Cited

U.S. PATENT DOCUMENTS 5,475,354 A * 12/1995 Valentian et al. ..... 335/296
5,581,155 A * 12/1996 Morozov et al. ..... 315/111.21

FOREIGN PATENT DOCUMENTS

JP 7-71361 A 3/1995
JP 2006-125236 A 5/2006

* cited by examiner

*Primary Examiner*—Michael Cuff
*Assistant Examiner*—Gerald L Sung
(74) *Attorney, Agent, or Firm*—Westerman, Hattori, Daniels & Adrian, LLP

(57) ABSTRACT

The present invention provides a hall-type electric propulsion that exhibits both overheating protection and operational stability, thereby simultaneously solving the problem of waste heat, which worsens with micronization, and the problem of discharge current oscillation. First, the magnetic flux distribution in ionization/acceleration channel is formed to optimize ion velocity vector, whereupon a propellant flow passage (propellant conduit) is disposed in a magnetic pole of the propulsion, or more specifically in the vicinity of the acceleration channel, and then propellant is passed through the flow passage. Thus, the magnetic pole, which is overheated by the generated plasma, can be cooled, and at the same time the propellant can be heated. Furthermore, the heated propellant is choked immediately before being introduced into the ionization/acceleration channel by a throat region provided immediately before the ionization/acceleration channel, and as a result the sonic speed of neutral species (propellant) is increased.

5 Claims, 7 Drawing Sheets

(Fig.1)
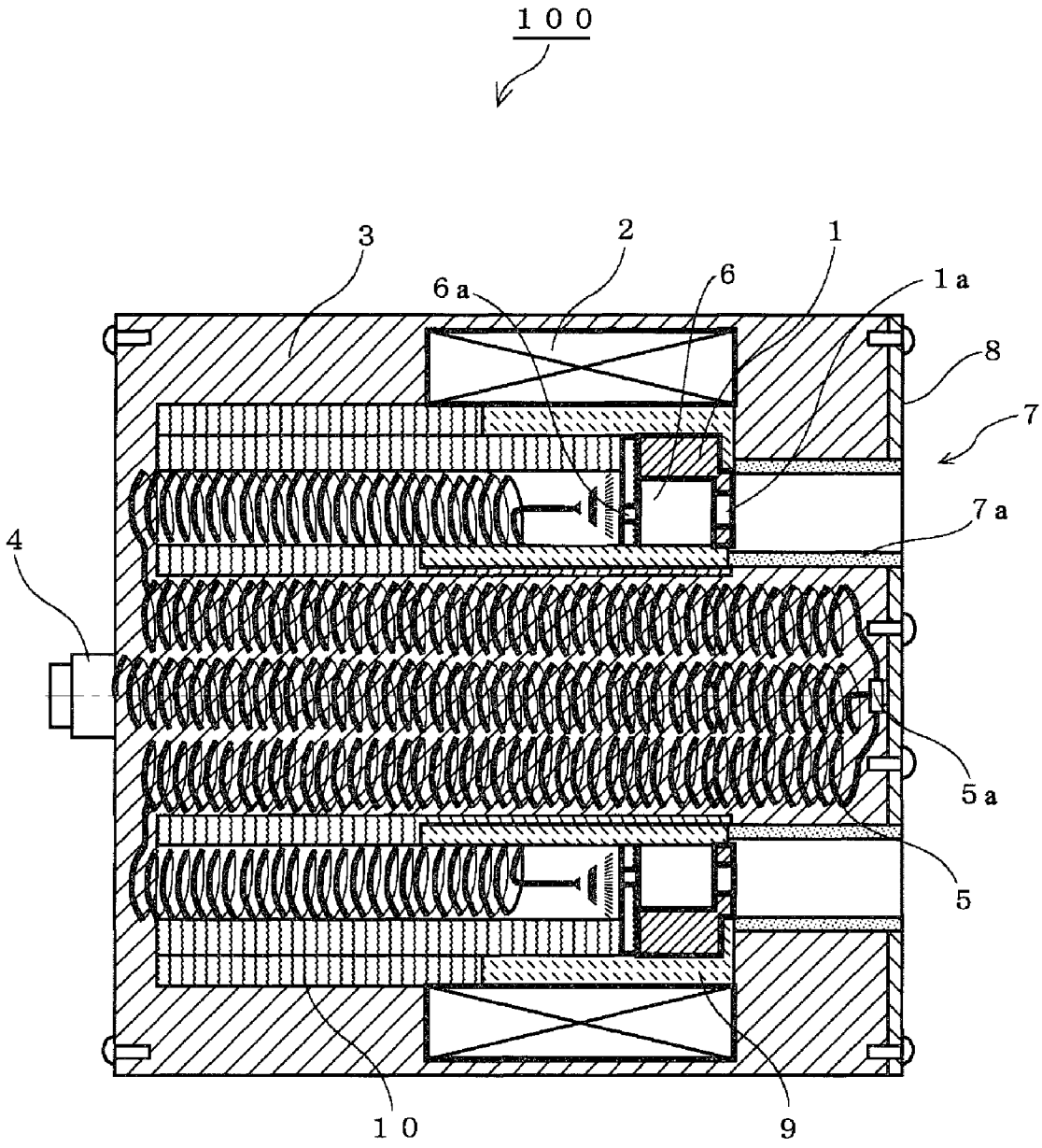

(Fig.2)
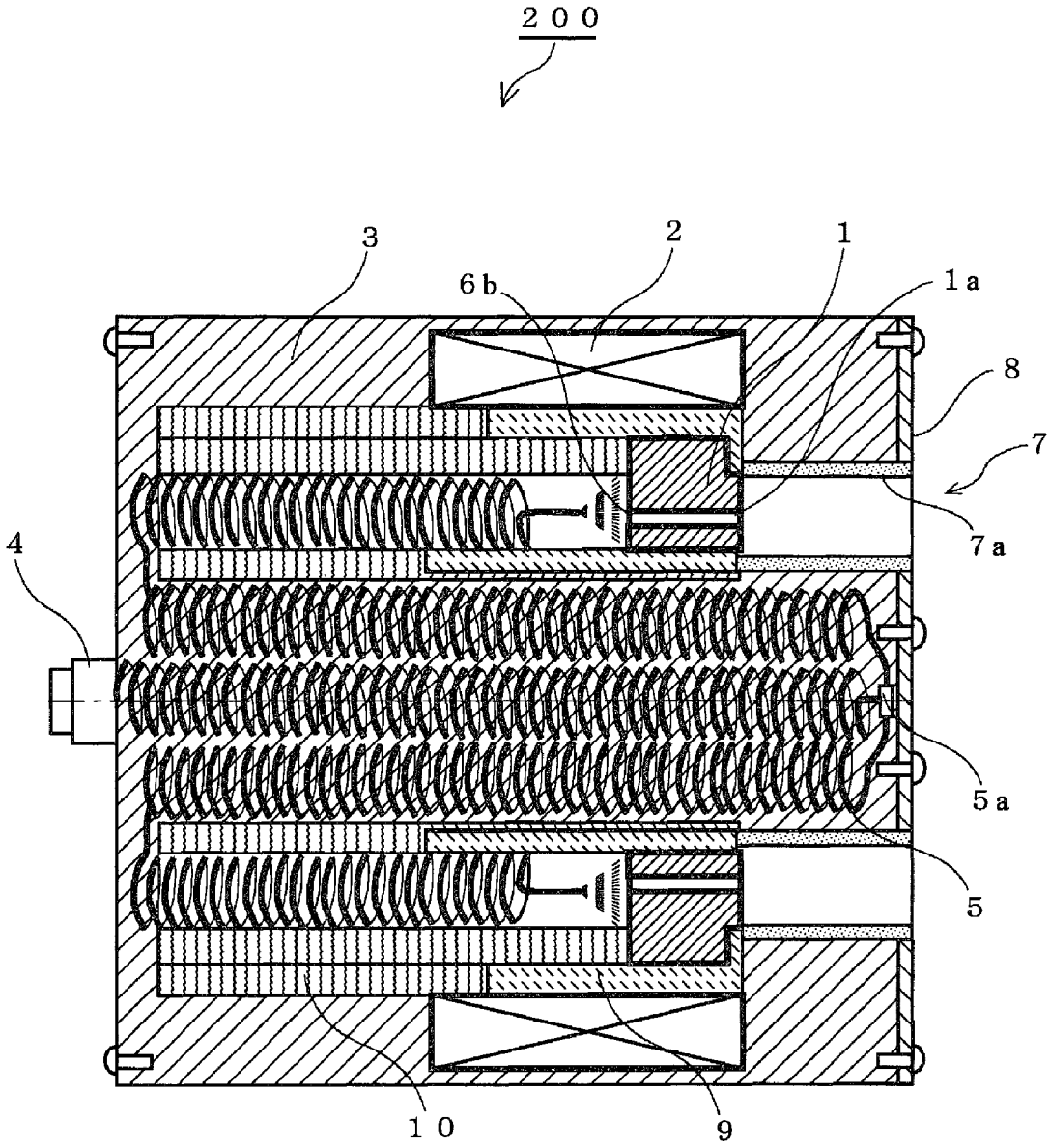

(Fig.3)
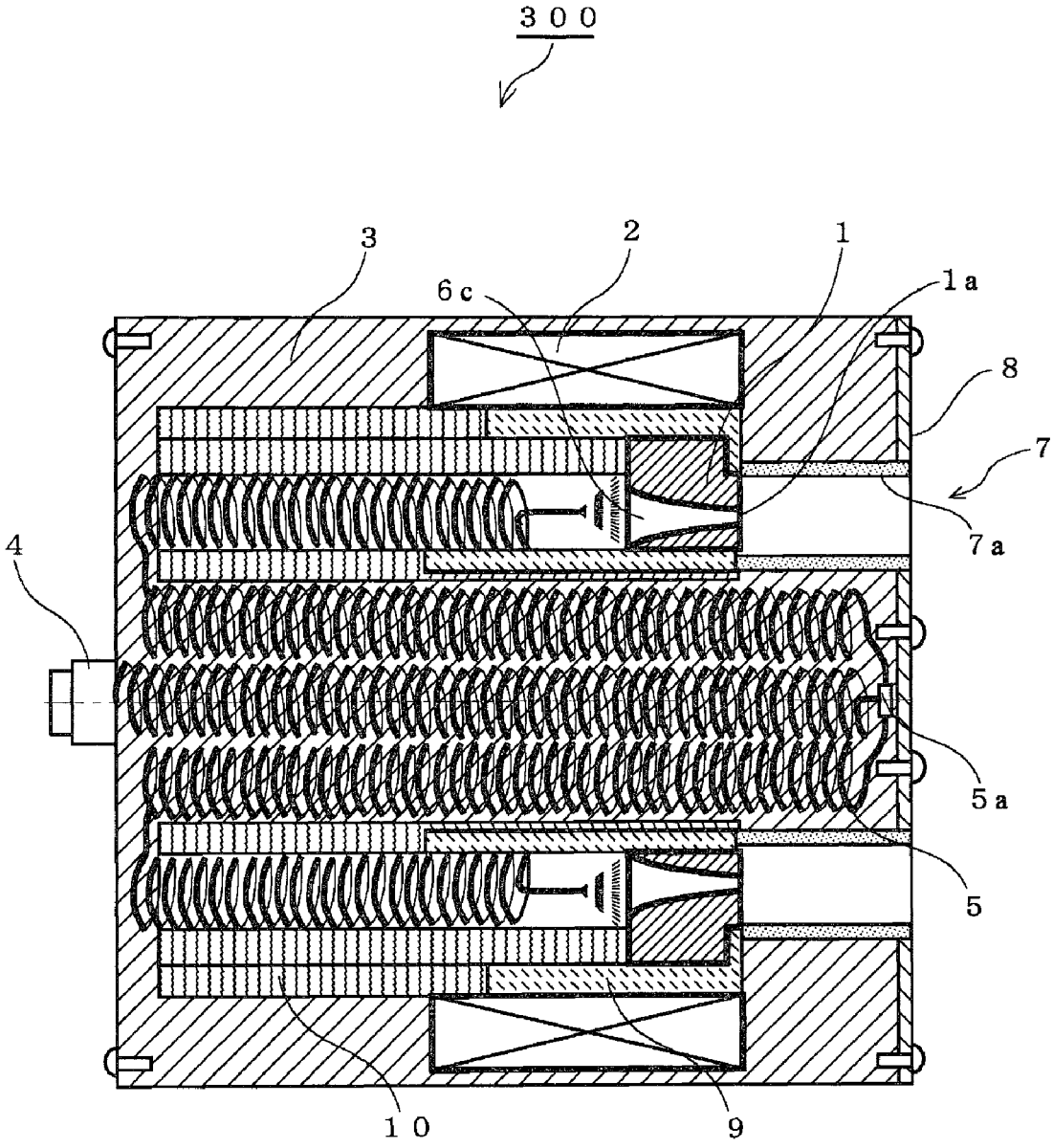

(Fig.4)
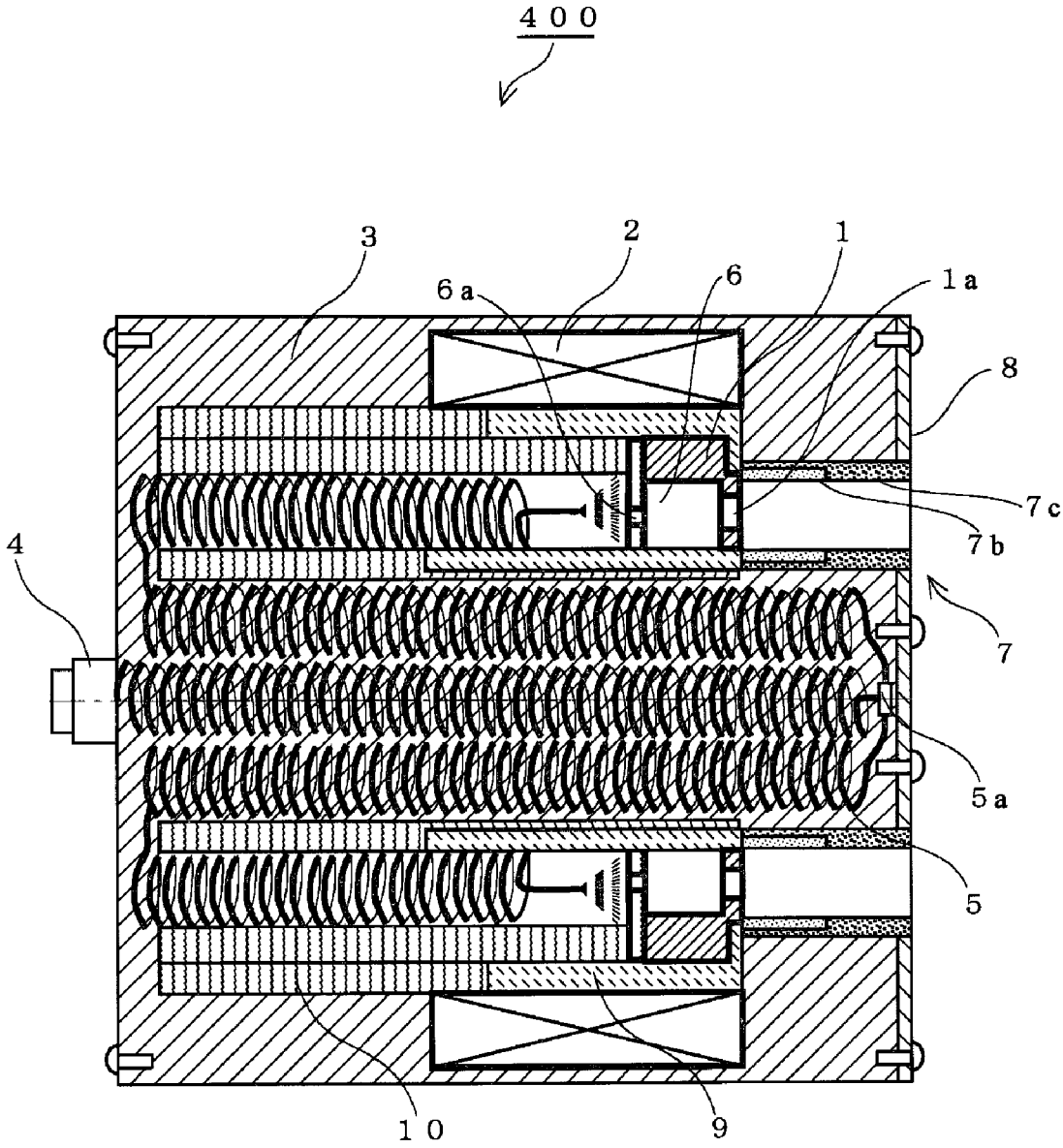

(Fig.5)
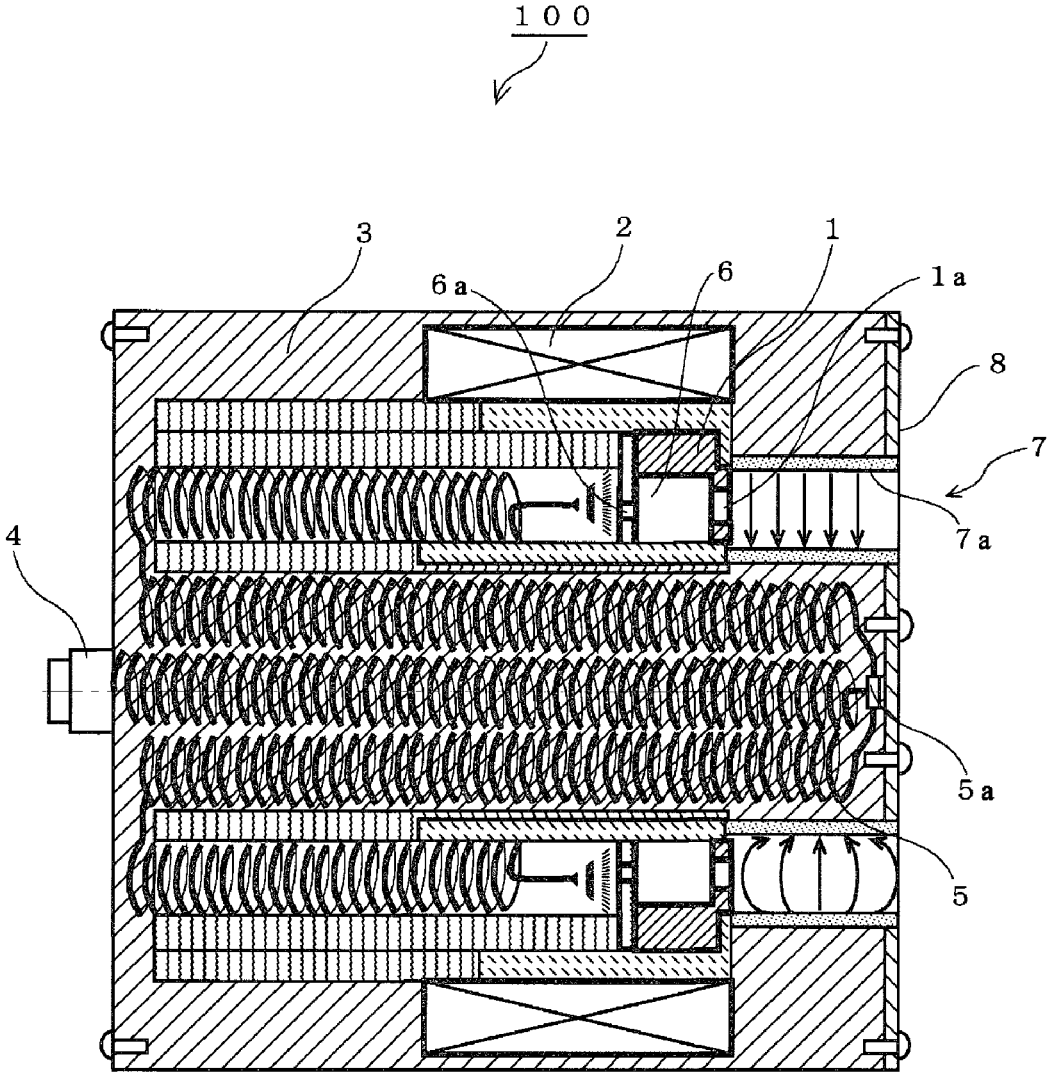

(Fig.6)
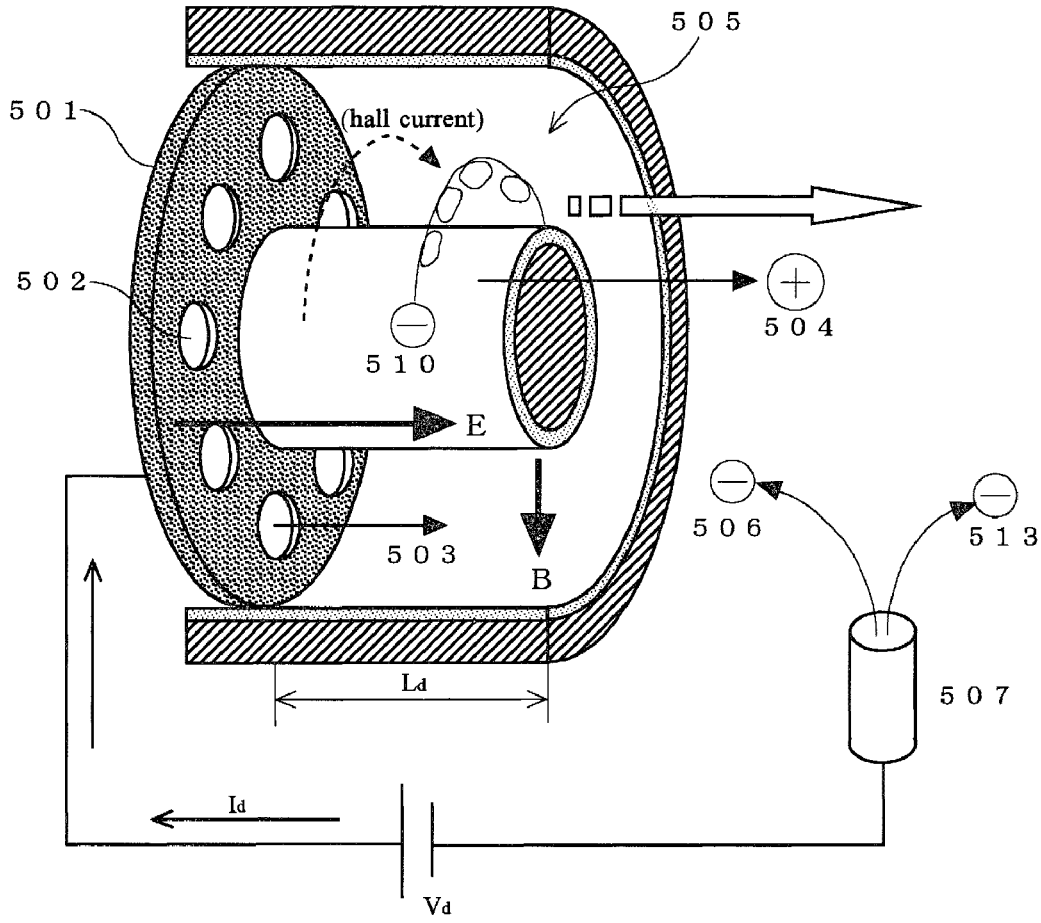

(Fig. 7)
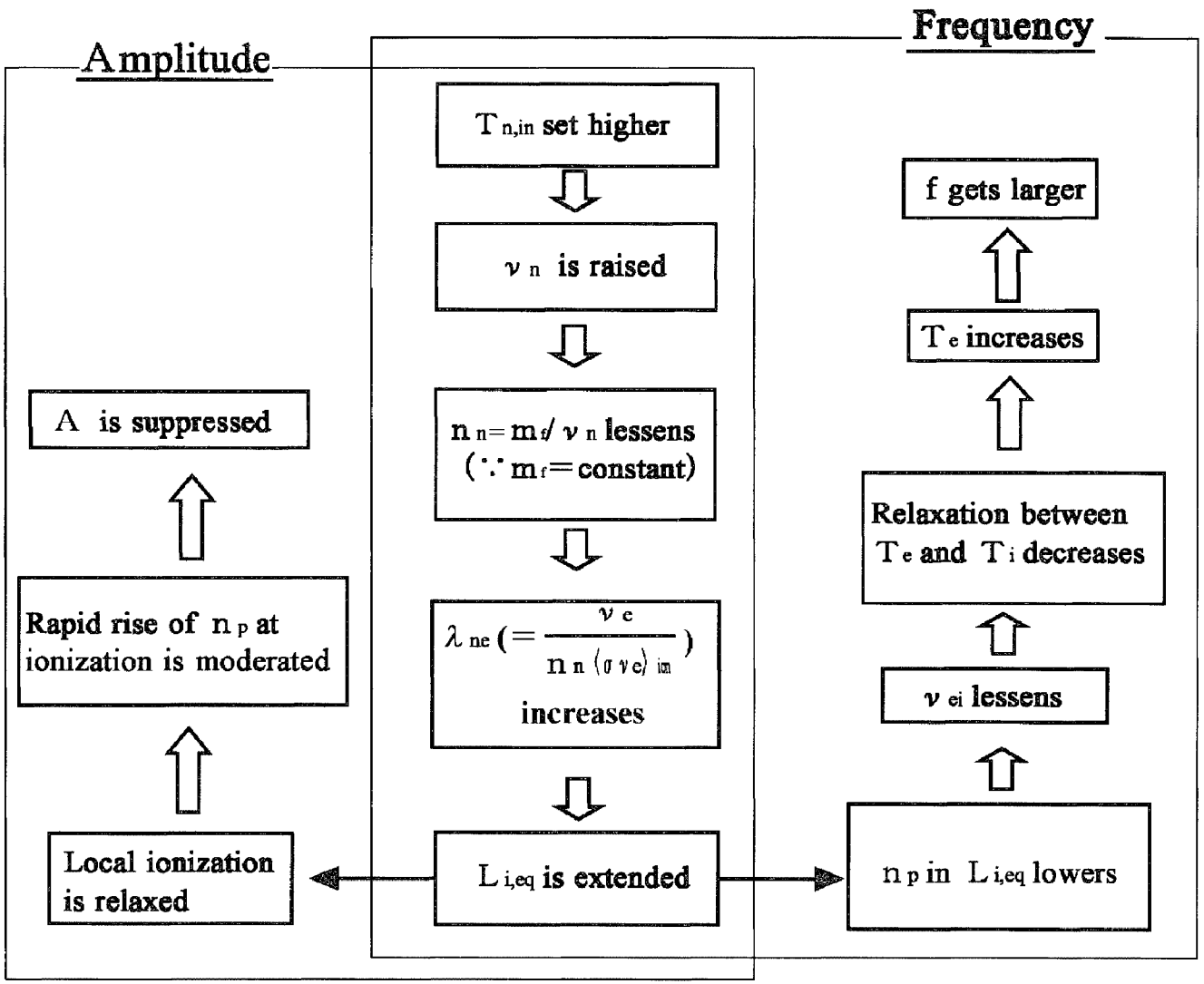

HALL-TYPE ELECTRIC PROPULSION

BACKGROUND OF THE INVENTION

1. Field of the Invention

The present invention relates to a hall-type electric propulsion, and more particularly to a hall-type electric propulsion that realizes both overheating protection and operational stability, thereby simultaneously solving the problem of waste heat which worsens with micronization and the problem of discharge current oscillation.

2. Description of the Related Art

In space propulsion systems, various functions including spacecraft station keeping and orbit correction are required, and therefore various propulsion systems covering a wide output range more than kN levels from mN levels are required. At the same time, functions such as minimization of impulse-bit, high-responsiveness, and lifespan extension have come to be required as a result of mission diversification. At present, chemical propulsion systems using hydrazine are used in apogee motors, station keeping thrusters and so on, while electric propulsion systems are used mainly to control the station and orbit of geo-stationary satellites. Since electric propulsion is high-specific impulse and low-thrust, and the dry weight of the power supply and so on is large, electric propulsion is particularly effective in missions requiring a large speed increment. As for missions requiring an extremely large speed increment, in many cases the only propulsion system capable of realizing such missions at present is electric propulsion. As electric propulsion becomes commercially viable, it has become important not only to improve the propulsion performance, but also to provide system interfaces superior to those of conventional propulsion units, which are problematic in terms of the optimization of plume plasma shape, electromagnetic interference, contamination, waste heat due to large power devices and so on.

An electric propulsion is a space propulsion that converts sunlight energy or the like into electric energy, uses the electric energy to turn a propellant into plasma through various methods, accelerates the generated plasma in various forms, and generates thrust from the resulting reaction. Electric propulsions can be largely divided into three types, namely an electrostatic acceleration type, an aero-thermal acceleration type, and an electromagnetic acceleration type, in accordance with differences in the thrust generation mechanism.

An ion engine, representing the electrostatic acceleration type, generates plasma through direct current discharge or the like, and obtains thrust by accelerating and injecting ions in the generated plasma using an electrostatic field (of approximately 1,000V) applied between porous grid. A considerably higher specific impulse (between 2,000 and 7,000 seconds) than that of a chemical propulsion can be achieved with high efficiency (up to 80%), but the thrust density is comparatively small (thrust=several mN to 200 mN) due to the restrictions of the space-charge limited current rule, and in the low specific impulse range, propulsion efficiency deteriorates dramatically. Several types of plasma generation methods, including an RF-type method, have been proposed.

A thrust generation mechanism of an arc jet-type electric propulsion, which serves as an aero-thermal acceleration-type propulsion, subjects a propellant to ionization and Joule heating through an arc discharge formed between a rod-shaped cathode and a ring-shaped anode disposed coaxially with the rod-shaped cathode, and then expands and accelerates the heated plasma using a supersonic nozzle. High thrust density (thrust=150 mN to 2N) is obtained, but heat loss onto the wall is large, and therefore the propulsion efficiency is low (30 to 40%) in comparison with an electrostatic acceleration-type propulsion, and the specific impulse (between 500 and 2,000 seconds) is not especially high. As regards commercial viability, the following important problems remain unsolved: (1) cathode wear, which determines durability, reaches 5 μg/C during a steady state operation, and this wear must be reduced; (2) heat loss must be improved.

An MPD (Magneto-Plasma-Dynamic)-type electric propulsion, which is a propulsion representing the electromagnetic acceleration type, has a similar basic structure to the arc jet-type electric propulsion. The propellant is heated and turned into plasma by arc discharge, whereupon a high discharge current in the order of kA is caused to flow between electrodes to induce a magnetic field in a circumferential direction. The generated plasma is accelerated in an axial direction by a Lorentz force, which is the interaction between the induced magnetic field and the current, and as a result, thrust is obtained. A feature of the MPD-type electric propulsion is that it obtains the highest thrust (up to 10N) of all electric propulsions, and is therefore promising as a propulsion for interplanetary navigation of the future. The obtained specific impulse has a wide range of approximately 1,000 to 6,000 s, but at present, the typical propulsion efficiency of approximately 10 to 50% remains low.

Finally, the hall-type electric propulsion according to the present invention will be described. As shown in FIG. 6, a hall-type electric propulsion has a ring-shaped, axisymmetrical acceleration channel 505 that turns a neutral particle (propellant) 503 introduced through an anode hole 502 into plasma and accelerates a generated ion 504. When a length $L_d$ of the acceleration channel is designed to be shorter than the ion cyclotron radius and longer than the cyclotron radius of an electron 506 (which is emitted from a cathode 507 and caused to flow in reverse through the acceleration channel in an anode direction), an electron 510 is subjected to E×B drift in the circumferential direction by the interaction between an axial electric field E and a radial external magnetic field B, whereby a "hall current (the name of which is derived from the hall-type electric propulsion)" is induced. By accelerating the ion 504 using an electric field generated through the electromagnetic interaction between the hall current and the externally applied magnetic field B, the hall-type electric propulsion acts in an identical manner to the "electrostatic acceleration type", and yet the hall-type electric propulsion also shares features with the "electromagnetic acceleration type" in that the accelerated ion 504 is neutralized using an electron 513 from the cathode and a high thrust density is obtained regardless of the space charge limited current rule by maintaining the quasi-neutrality of the acceleration-zone (the acceleration mechanism will be described in further detail below). Hence, in principle, a high specific impulse (up to 3,000 s), a high thrust efficiency (70%) and a high thrust density (up to 1.5N) are all achievable (see Japanese Unexamined Patent Application Publication H7-71361 and Japanese Unexamined Patent Application Publication 2006-125236, for example).

The discharge characteristic (current-voltage characteristic) of the hall-type electric propulsion is divided into two operating modes, namely a "high voltage mode" and a "low voltage mode". An operating mode in which the discharge current increases dramatically when the discharge voltage is raised is known as a "low voltage mode". The discharge current is the product of charge density and velocity, but in the operating range of the low voltage mode, the degree of propellant ionization in the acceleration channel is low, and therefore, when the discharge voltage is raised to promote propellant ionization, the charge density increases, leading to an increase in the discharge current. Meanwhile, when the discharge voltage is raised further, the operating mode shifts to the "high voltage mode", in which the discharge current increases more gently relative to increases in the discharge voltage. The reason for this is that since the propellant is already fully ionized in the high voltage mode, further current increases are not complemented by charge increases due to ionization, and therefore the current increases must be complemented by increases in ion velocity, which serves as another current increasing element, alone. The point at which the discharge current increase varies dramatically is known as the "knee point", and the current value at that time is known as the "knee current". Since the knee current is highly dependent on the discharge current amount when the propellant is completely ionized, the Knee current decreases as the flow rate of the propellant decreases.

With respect to thrust generation, one problem of the hall-type electric propulsion is a discharge current oscillation phenomenon, which is observed during an operation in the high voltage mode (as described above, in a region of the discharge characteristic at and above the "knee point", where the discharge current substantially stops varying relative to the discharge voltage), which is the normal operating mode of a hall-type electric propulsion. Discharge current oscillation causes reductions in the propulsion performance and durability as well as operational instability, and in order to respond to space missions requiring a high reliability for a long period and a long lifespan, it is vital to learn the physical mechanisms of discharge current oscillation and establish design guidelines for solving it. Low-frequency discharge current oscillation in the 20 kHz-range, which is particularly prevalent during a high voltage mode operation, has the greatest amplitude of the various coexisting oscillation components, and as the discharge voltage increases, the discharge current shifts from oscillation to instability such that finally, it becomes impossible to maintain discharge, and the operation will be halted.

In discharge current oscillation, various oscillation components coexist over a wide frequency band range extending from kHz to MHz. The oscillation components have been classified into the following five frequency bands using the frequency order and oscillation characteristic as references.

| | | |
|---|---|---|
| 1. | Ionization Oscillation: | $10^4$ to $10^5$ Hz |
| 2. | Transit-time Oscillation: | $10^5$ to $10^6$ Hz |
| 3. | Electron-drift Oscillation: | $10^6$ to $10^7$ Hz |
| 4. | Electron-cyclotron Oscillation: | $10^9$ Hz |
| 5. | Langmuir Oscillation: | $10^8$ to $10^{10}$ Hz |

Of these five types of oscillation, the first three occur particularly strikingly during an operation of a hall-type electric propulsion, while GHz order-oscillation of the fourth and fifth types is unique to plasma and therefore considered unavoidable. Low-frequency discharge current oscillation in the 20 kHz-range has the greatest amplitude of the various coexisting oscillation components and leads directly to operational instability, and is therefore of particular importance with respect to the propulsion performance. Up to the present day, 20 kHz-range oscillation has been considered a phenomenon that is caused by the first oscillation type (Ionization Oscillation) due to its frequency order.

As regards the features and problems of a micro hall-type electric propulsion in which the size of the propulsion is small, a reduction in weight and a corresponding reduction in launch costs can be achieved, and therefore demand for this type of propulsion in a micro-spacecraft of 100 kg or less is high. A high-specific impulse, small-sized propulsion, with which an increase in payload ratio and a reduction in fuel consumption can be realized, shows promise as a propulsion system for installation in such a micro-spacecraft. Due to their low power consumption and ability to generate thrust semi-continuously over a long time period, hall-type electric propulsions show particular promise in cases where communication satellites having high business needs are subjected to station keeping at a low orbit near Earth. However, a high-performance, small-sized hall-type electric propulsion has not yet been realized.

The reason (problem) why it is difficult to realize this type of propulsion is that when a magnetic pole (material: soft iron) forming a magnetic circuit generated by a magnetic coil installed in the propulsion is overheated to or above a magnetic transformation point, the magnetic susceptibility of the soft iron varies, causing a distortion in the magnetic line of force distribution (initial design). When the magnetic line of force distribution distorts, the acceleration vector of the ions that are accelerated by the electromagnetic field (electromagnetic force) becomes offset, and as a result, the ions collide on the acceleration channel wall surface before being emitted to the exterior of the acceleration channel. This leads not only to the reduction in propulsion efficiency (see Equation (25), to be described below) due to ion loss, but also to sputtering on the acceleration channel wall surface. As a result of this wear, the thickness of the acceleration channel wall surface material (material: ceramic, alumina-type ceramic; $3Al_2O_3/2SiO_2$ or boron nitride; BN), which acts as a heat-resistant/insulating wall, decreases locally, leading to a reduction in the heat resistance property against magnetic pole heating by plasma, and consequently a further increase in magnetic pole overheating. This vicious circle worsens as the size of the hall-type electric propulsion decreases. More specifically, as the size decreases, the acceleration channel width narrows, leading to increases in ion sputtering wear on the wall surface and waste heat deterioration. Furthermore, the amount of wall surface loss in the narrow acceleration channel becomes particularly large as micronization advances, and hence it is vital that the aforementioned oscillation phenomenon be solved in order to create a micro hall-type electric propulsion system.

SUMMARY OF THE INVENTION

As described above, when the size of a hall-type electric propulsion is reduced, magnetic pole overheating in the vicinity of the ionization/acceleration channel worsens, leading to variation in the distribution of magnetic force lines and the magnetic susceptibility of the soft iron, and thus the ion vector that produces thrust becomes offset. As a result, the ions sputter against the channel wall surface insulator, leading to deterioration of the insulating property of the channel wall surface, reductions in durability and lifespan, and performance reductions in propulsion efficiency and so on.

Operational instability due to discharge current oscillation during a high voltage mode operation is also problematic.

The present invention has been designed in consideration of these problems in the prior art, and it is an object thereof to provide a hall-type electric propulsion that exhibits overheating protection and operational stability, thereby simultaneously solving the problem of waste heat, which worsens with micronization, and the problem of discharge current oscillation.

To achieve this object, in a hall-type electric propulsion described in claim 1, which obtains thrust through emitting generated plasma from an acceleration channel by electrostatic acceleration or electromagnetic acceleration, an electromagnetic coil for magnetizing a magnetic material to generate a magnetic field is disposed on an outer side of the acceleration channel portion and a propellant conduit for transporting a propellant is formed such that it is led into a plenum chamber upstream of the acceleration channel past the vicinity of a wall surface of the acceleration channel.

In the hall-type electric propulsion described above, first, an electromagnetic coil is disposed on the outside of the acceleration channel so that heat generated by the electromagnetic coil can be released to the outside and a so-called heat accumulation remaining in the propulsion can be eliminated. Further, the propellant conduit is disposed along the vicinity of the acceleration channel, which is the most critical location thermally, and therefore heat exchange is performed between the propellant flowing through the interior thereof and the vicinity of the acceleration channel. As a result, the vicinity of the acceleration channel receives cold from the propellant so as to be cooled, while the propellant is preheated by sensible heat from the vicinity of the acceleration channel. Hence, overheating of the magnetic pole in the vicinity of the acceleration channel is prevented favorably, and as a result, distortion of the line of magnetic force distribution caused by variations in magnetic susceptibility is suppressed favorably and the ionic velocity vector is optimized. As a result, ions do not collide with the wall surface of the acceleration channel, thereby preventing deterioration of the insulation performance and enabling an improvement in durability. Further, by raising the temperature of the propellant (increasing the acoustic velocity of the neutral particles through choking), rapid ionization of the neutral particles (propellant) can be suppressed, and this contributes favorably to operational stabilization.

In the hall-type electric propulsion described in claim 2, the propellant conduit is wound into a spiral shape.

By providing the hall-type electric propulsion with this constitution, a large contact area can be secured between the acceleration channel and the magnetic pole, and as a result, these portions can be cooled favorably.

In the hall-type electric propulsion described in claim 3, the plenum chamber comprises a choking portion for increasing a flow rate of the propellant.

As a result of committed research by the present inventors, it was discovered that reductions in the propulsion performance and durability of the propulsion, as well as low-frequency discharge current oscillation leading to operational instability, are caused by rapid ionization (an increase in plasma density) in the ionization/acceleration channel, whereby the ionized ions are moved rapidly from the ionization-zone by the electric field. This mechanism will now be described briefly.

Low-frequency discharge current oscillation is based on a mechanism whereby a disturbance occurs as a result of ionization interaction between resonating plasma and neutral particles. More specifically, (1) ionization leads to an increase in plasma density and a reduction in neutral particle density. (2) The charged particle velocity is higher than the neutral particle velocity when an electric field is applied, and therefore the reduction in plasma is greater than the supply of neutral particles. (3) The neutral particles are supplied (in this period, the collision frequency is low and almost no ionization takes place). (4) Once the neutral particles have been supplied to a certain extent, ionization begins, whereupon the process returns to (1).

Here, a new parameter referred to as an equilibrium ionization-zone length is proposed. A position in which 5% of the density of the neutral particles supplied from the anode has been consumed is envisaged as an ionization start position, and a position in which 95% of the density of the neutral particles supplied from the anode has been consumed is envisaged as an ionization completion position. As a result, an ionization-zone length $L_i$ is defined as the distance between the ionization start position and the ionization completion position. The ionization-zone length $L_i$ varies over time, and therefore an equilibrium ionization-zone length $L_{i,\ eq}$ is defined as a time equilibrium value of the ionization-zone length.

A method of increasing the temperature of the neutral particles that flow into the ionization-zone is proposed as a method of suppressing the amplitude of low-frequency discharge current oscillation. When the temperature of the inflowing neutral particles is increased, the neutral particle velocity upon introduction into the ionization-zone is increased, thereby increasing the equilibrium ionization-zone length, and as a result, rapid increases in plasma density during ionization are suppressed, thereby suppressing the amplitude.

More specifically, when an inflow velocity $v_n$ increases due to an increase in a neutral particle inflowing temperature $T_{n,\ in}$ and a flow rate $m_f$ is constant, the neutral particle density $n_n=m_f/v_n$ decreases. As a result, an average free path:

$$\lambda_{ne}=v_e/n_n/\langle\sigma_{Ve}\rangle_{ion}$$

relative to ionization collisions between neutral particles and electrons in the interior of the acceleration channel increases. Here, $\langle\sigma_{Ve}\rangle_{ion}$ is an ionization coefficient shown in the following equation.

$$\langle\sigma_{Ve}\rangle_{ion}=\sigma(8kT_e/\pi/m_e)^{1/2}(1+eV_i/k/T_e)\exp(-eV_i/k/T_e)$$

where $\sigma$=the ionization cross section, k=Boltzman's constant, $m_e$=the electron mass, e=the elementary electric charge, and $V_i$=the ionization voltage. Hence, the ionization completion position shifts to the downstream side (the equilibrium ionization-zone length increases), and as a result, rapid increases in plasma density during ionization are alleviated, and the amplitude A decreases (see FIG. 7).

By providing the hall-type electric propulsion with this constitution, the acoustic velocity of the propellant (neutral particles) is increased by passing the preheated propellant through the choking hole provided immediately before the acceleration channel, and since rapid ionization of the neutral particles is suppressed by the increase in acoustic velocity, a stable operation can be obtained.

In the hall-type electric propulsion described in claim 4, an anode that forms an electric field constitutes the choking portion.

By providing the hall-type electric propulsion with this constitution, the acoustic velocity of the propellant (neutral particles) can be increased favorably.

In the hall-type electric propulsion described in claim 5, a clearance of a gap of the choking portion decreases toward an axial downstream side.

By providing the hall-type electric propulsion with this constitution, the acoustic velocity of the propellant (neutral particles) can be increased favorably.

In the hall-type electric propulsion described in claim 6, the wall surface of the acceleration channel is formed by combining wall surfaces made of different heat-resistant insulators in accordance with an ionization-zone in which the plasma is generated and an acceleration-zone in which ions in the plasma are accelerated, respectively.

Following long-term use, a stepped groove forms in the surface of the insulator, and when this groove increases in depth, the acceleration channel deforms, leading to a reduction in the ion extraction performance.

Hence, in this hall-type electric propulsion, wall surfaces having a material that is suited to each of the acceleration-zone and the ionization-zone are selected, as shown in FIG. 4 to be described below, enabling improvements in efficiency and durability (sputtering suppression).

In the hall-type electric propulsion described in claim 7, one of the heat-resistant insulators is boron nitride (BN) or its composite.

In this hall-type electric propulsion, boron nitride (BN) is used as the material for the acceleration channel wall surface rather than an alumina-type ceramic ($3Al_2O_3/2SiO_2$ or the like), and therefore the discharge current value required to obtain identical thrust can be reduced.

According to the hall-type electric propulsion of the present invention, overheating of a magnetic pole in the vicinity of an ionization/acceleration channel, which worsens as the size of the propulsion is reduced (with micronization), can be prevented favorably, and low-frequency discharge current [oscillation], which causes reductions in the propulsion performance and durability and also operational instability, can be suppressed favorably.

BRIEF DESCRIPTION OF THE DRAWINGS

FIG. 1 is an illustrative sectional view showing the main parts of a micro hall-type electric propulsion according to a first embodiment of the present invention;

FIG. 2 is an illustrative sectional view showing the main parts of a micro hall-type electric propulsion according to a second embodiment of the present invention;

FIG. 3 is an illustrative sectional view showing the main parts of a micro hall-type electric propulsion according to a third embodiment of the present invention;

FIG. 4 is an illustrative sectional view showing the main parts of a micro hall-type electric propulsion according to a fourth embodiment of the present invention;

FIG. 5 is an illustrative sectional view showing the main parts of magnetic flux distribution in an acceleration channel;

FIG. 6 is an illustrative view showing an acceleration principle of a hall-type electric propulsion; and FIG. 7 is an illustrative view showing a mechanism whereby a reduction in amplitude and an increase in frequency occur as neutral species temperature increases.

DESCRIPTION OF THE PREFERRED EMBODIMENTS

The present invention will now be described in further detail through the embodiments shown in the drawings.

First Embodiment

FIG. 1 is an illustrative sectional view showing the main parts of a micro hall-type electric propulsion 100 according to a first embodiment of the present invention.

The micro hall-type electric propulsion 100 mainly comprises an anode 1 that forms a pair with a cathode (not shown) for neutralizing ions and supplying electrons, and forms an electric field E for subjecting the ions to electrostatic acceleration in an axial direction, a magnetic coil 2 that magnetizes a concentric cylinder-shaped magnetic pole having a ring-shaped axisymmetrical channel, a magnetic pole 3 that is magnetized by the magnetic coil 2 to form a magnetic field B for subjecting the ions to electromagnetic acceleration in a radial direction, a propellant introduction port 4 serving as a propellant inlet, a propellant conduit 5 for transporting the propellant, a plenum chamber 6 having a choking portion 6*a* for choking the flow of preheated propellant to increase its sonic speed, an acceleration channel 7 for subjecting ions in plasma to electrostatic or electromagnetic acceleration, and heat-resistant insulators 8, 9 and 10 for preventing short-circuiting of a discharge current, an ion beam current, and so on.

The propellant conduit 5 takes a spiral tube form, and is made of material such as copper, for example. The advantages of using copper are that it exhibits high thermal conductivity (thermal conductivity=381 [W/mK]) and excellent heat resistance (melting point=1357.6K), and is easy to process and reasonably priced. Furthermore, since it is a diamagnetic substance (magnetic susceptibility=−0.086), it has no effect on the magnetic field distribution of the magnetic pole. Further, the propellant conduit 5 is constituted to penetrate the center of the magnetic pole 3 longitudinally, change its orientation by branching into a plurality of flow passages at a branch port 5*a*, penetrate longitudinally toward the propellant introduction port 4 side in the vicinity of an acceleration channel wall 7*a*, and then turn back near the bottom portion thereof so as to be led into the plenum chamber. With this constitution, the vicinity of the acceleration channel wall 7*a*, which is the hottest part of the magnetic pole 3, is cooled appropriately by the propellant, and therefore overheating of the magnetic pole near the acceleration channel wall 7*a* can be prevented. Overheating of the magnetic pole near the acceleration channel wall 7*a* becomes particularly severe as the size of the propulsion decreases (as micronization progresses), but by constituting the propellant conduit 5 in this manner, overheating of the magnetic pole near the acceleration channel wall 7*a* can be prevented favorably, and the magnetic flux distribution of the magnetic field that is formed in the radial direction of the acceleration channel 7 can be stabilized. Simultaneously, the propellant flowing through the interior of the propellant conduit 5 is choked in the plenum chamber 6 while being preheated by sensible heat from the magnetic pole near the acceleration channel wall 7*a*. As a result, the speed of neutral species (propellant) increases, rapid ionization of propellant (neutral species) is suppressed, and thus a stable operation can be obtained.

The magnetic coil 2 is disposed on the outer side of the acceleration channel 7 and the magnetic pole 3. This disposition contributes to the prevention of overheating in the vicinity of the acceleration channel 7 due to waste heat generated by the magnetic coil 2 upon passage of electrical current. Hence, due to the external disposition of the magnetic coil 2 and the constitution of the propellant conduit 5 described above, the micro hall-type electric propulsion 100 is capable of realizing overheating protection.

Second Embodiment

FIG. 2 is an illustrative sectional view showing the main parts of a micro hall-type electric propulsion 200 according to a second embodiment of the present invention.

In the micro hall-type electric propulsion 200, a choking portion 6*b* is formed (manufactured) by extending the anode 1 and reducing the size of the anode hole 1*a*. All other constitutions are identical to the micro hall-type electric propulsion 100 described above. By manufacturing the micro hall-type electric propulsion 200 in this manner, the propellant can be choked, enabling an increase in sonic speed, similarly to the micro hall-type electric propulsion 100. Therefore, similarly to the micro hall-type electric propulsion 100, the micro hall-type electric propulsion 200 also realizes both overheating protection and operational stability.

Third Embodiment

FIG. 3 is an illustrative sectional view showing the main parts of a micro hall-type electric propulsion 300 according to a third embodiment of the present invention.

In this micro hall-type electric propulsion 300, a choking portion 6*c* for choking the propellant is formed (manufactured) by a throat having a gap that reduces steadily instead of a region having a fixed flow passage gap. By manufacturing the micro hall-type electric propulsion 300 in this manner, stagnation of the flow near the corners of the plenum chamber can be avoided, and the neutral species of propellant, which are preheated in the propellant flow passage (propellant conduit 5), can be led to the anode 1*a* after being rectified. Hence, similarly to the micro hall-type electric propulsions 100 and 200 described above, the micro hall-type electric propulsion 300 also realizes both overheating protection and operational stability. Note that all other constitutions are identical to those of the micro hall-type electric propulsion 100 described above.

Fourth Embodiment

FIG. 4 is an illustrative sectional view showing the main parts of a micro hall-type electric propulsion 400 according to a fourth embodiment of the present invention.

In the micro hall-type electric propulsion 400, the wall surface of the acceleration channel 7 is formed by a plurality of acceleration channel walls 7*b*, 7*c*. By selecting materials respectively suited to the respective wall surfaces corresponding to the internal acceleration-zone and ionization-zone, improvements in efficiency and durability (sputtering suppression) can be achieved. For example, the acceleration channel wall 7*b* corresponding to the ionization-zone is formed from an alumina-type ceramic ($3Al_2O_3.2SiO_2$ etc.) material or the like, whereas the acceleration channel wall 7*c* corresponding to the acceleration-zone is formed from a boron nitride (BN) material or the like.

According to the micro hall-type electric propulsions 100, 200, 300 and 400 of the first through fourth embodiments, first the magnetic field distribution of the ionization/acceleration channel is formed so as to optimize the ion acceleration vector, whereupon the propellant flow passage (propellant conduit 5) is disposed in the magnetic pole of the propulsion, or more specifically in the vicinity of the acceleration channel 7, and then propellant is passed through the flow passage. Thus, the magnetic pole, which is overheated by the generated plasma, can be cooled, and at the same time the propellant can be heated. Furthermore, the heated propellant is choked immediately before being introduced into the ionization/acceleration channel by the throat region or throttling hole provided immediately before the ionization/acceleration channel, and as a result the sonic speed of the propellant (neutral species) is increased. Moreover, operational instability, which is a problem of conventional hall-type electric propulsions, is caused when rapid ionization (an increase in plasma density) occurs in the ionization/acceleration channel such that the ionized ions are moved rapidly from the ionization-zone by the electric field, but due to the increase in acoustic velocity in the inventions described above, rapid ionization of the neutral species can be suppressed (the ionization-zone can be extended), and as a result rapid ionization is alleviated, thereby alleviating instability during ionization and providing operational stability. Furthermore, the inventions described above do not require new, complicated systems.

In particular, when boron nitride (BN) is used as the material for the acceleration channel wall surface rather than an alumina-type ceramic ($3Al_2O_3.2SiO_2$ or the like), the discharge current value required to obtain identical thrust can be reduced. Further, following long-term use, a stepped groove forms in the surface of the insulator, and when this groove increases in depth, the acceleration channel deforms, leading to a reduction in the ion extraction performance. In the present invention, however, wall surfaces having a material that is suited to each of the acceleration-zone and the ionization-zone are selected, as shown in FIG. 4, enabling improvements in efficiency and durability (sputtering suppression).

In addition, the lines of magnetic force applied to the acceleration channel interior are formed to be perpendicular to the acceleration channel axial direction, as shown in the upper half of FIG. 5. Therefore, the acceleration vector for accelerating the generated ions becomes perpendicular to the applied lines of magnetic force distribution (=parallel to the acceleration channel axial direction) such that theoretically, the ions are emitted to the exterior of the channel collisionlessly and generate thrust. As shown in the lower half of FIG. 5, however, when the lines of magnetic force distort, the wall surface sputtering ratio of the generated ions increases, leading to reductions in propulsion efficiency and durability.

Incidentally, technical research known as laser drag reduction exists as a method of reducing drag in aircraft. In this method, laser beams are converged on the front of the nose of the aircraft such that gas near the convergence point is turned into plasma. Through plasmarization, the temperature of the gas increases, leading to an increase in the sonic speed of the gas particles. The flight Mach number is defined as a value obtained by dividing the flying speed of the aircraft by the sonic speed. As the Mach number increases, drag (in particular, wave drag at supersonic speeds) increases. When the sonic speed value of the denominator increases at an identical flying speed, the flight Mach number decreases relatively. Hence, by increasing the temperature of the drag-generating airflow at the front of the aircraft through plasmarization, drag can be locally/effectively reduced. However, plasma generation using laser is attributable to focusing and therefore produces point generation. Accordingly, this method can only be applied to narrow regions such as the nose of the aircraft. When the present invention (device) is applied, drag reduction can be achieved in various locations. For example, the present invention may be used on the main wing, which is the generation source of strong drag. In other words, the plasma ejection method of a hall-type electric propulsion system is employed. Since the present system is capable of surface generation rather than point generation using laser, it can cover the long span length of the main wing when installed in a plurality (needless to say, the present system may be used in the inner wing, which generates great drag, alone). With a hall-type electric propulsion system, plasma is generated in advance and ejected to the front of the main wing, and therefore the gas at the front of the main wing can be heated. When a hall-type electric propulsion system is used, the ejected plasma can be formed on a surface, and moreover, when the hall-type electric propulsion system is micronized, it can be built into the thin wings of supersonic aircraft. Further, oxygen from the air, which can be supplied easily from the atmosphere during flight, is used as the raw material of the plasma (corresponding to the propellant in a propulsion). Oxygen has a large ionization cross section, and therefore plasma can be generated even at a low ionization voltage. As a result, an improvement in the efficiency of the introduced energy can be achieved.

Further, in nuclear fusion, a beam heating method in which ions in the generated plasma are emitted as high-energy beams using an electromagnetic field is effective in the ultra high temperature heating of plasma. A hall-type ion beam source is the most promising since it is not restricted by the space charge limited current rule, and can therefore generate/accelerate high-density plasma. However, to generate and accelerate the plasma, the vicinity of the acceleration channel is exposed to extremely high temperatures. Moreover, an unstable current remains. According to the present invention, this type of nuclear fusion ion beam source can be stabilized, and made highly efficient and highly durable.

For reference, the basic design of a micro hall-type electric propulsion will now be described.

The design conditions of a hall-type electric propulsion are listed below in (1) to (3). An acceleration channel sectional area S, a discharge voltage $V_d$, a discharge current $I_d$, a magnetic flux density B, and an average electron temperature $T_e$ are set as a performance prediction reference model.

(1) In the acceleration channel, (a) electrons must be trapped in a magnetic field to form a hall current, and (b) a condition that ions are not trapped in magnetic field is required to accelerate ions electrostatically.

From these conditions, the following equation must be satisfied in relation to the cyclotron radii of ion and electron=$r_{ci}$, $r_{ce}$ for the acceleration channel length L.

$$r_{ce} \ll L < r_{ci} \tag{1}$$

Here, the ion and electron cyclotron radii are calculated respectively as follows:

$$r_{ci} = M_{Vi}/(eB) \tag{2}$$

$$r_{ce} = m_{Ve}/(eB) \tag{3}$$

where M, m=the mass of ion and electron, $v_i$, $v_e$=the ion and electron velocity in the perpendicular direction to the magnetic field, and e=electronic charge. Ions are generated near the anode and accelerated by the difference of electric potential between the acceleration channel. And assuming that ion-loss does not occur through the acceleration channel, ion current density $J_i$ is maintained and expressed by the following equation.

$$J_i = env_i \tag{4}$$

where n=the plasma density. Here, considering an ideal case in which the acceleration efficiency, which is defined by (ion beam current $I_b$)/(discharge current $I_d$), =1, the ion current density is estimated as follows.

$$J_i = I_d/S[A/m^2] \tag{5}$$

Further, assuming that ions are accelerated ideally for discharge voltage $V_d$, ion velocity $v_{i,ex}$ at the acceleration channel exit becomes $$\tfrac{1}{2} \times M v_{i,ex}^2 = eV_d \tag{6}$$

on the relationship that kinetic energy at acceleration channel exit=energy received from electric field, and therefore $$v_{i,ex} = (2eV_d/M)^{1/2}[m/s] \tag{7}$$

Thus, the ion cyclotron radius $r_{ci}$ is determined.

Next, using Equation (4), the average plasma density n is determined according to the following equation:

$$n = (1/L) \times \int_0^L J_i/(ev_i)dx = J_i/(eL) \times \int_0^L 1/v_i dx \tag{8}$$

Assuming that electric field is distributed evenly in the axial direction of the acceleration channel, the difference of electric potential at x is $$V(x) = x/L \times V_d \tag{9}$$

and therefore ion velocity becomes $$v_i(x) = (2eV(x)/M)^{1/2} = (2exV_d/M/L)^{1/2} \tag{10}$$

By introducing Equation (10) into Equation (8), average plasma density is expressed in the following manner, using ion velocity $v_{i,ex}$ at channel exit of Equation (7):

$$n = 2J_i/(ev_{i,ex})[1/m^3] \tag{11}$$

In other words, the average plasma density is double the plasma density $$n_{ex} = J_i/(ev_{i,ex}) \tag{12}$$

at the acceleration channel exit, which is determined using Equation (4), and therefore the corresponding average ion velocity $v_i$ in the acceleration channel=½ the ion velocity $v_{i,ex}$ at channel exit.

Meanwhile, the average electron velocity $v_e$ becomes $$v_e = (2eV_d/m)^{1/2}[m/s] \tag{13}$$

and thus the electron cyclotron radius $r_{ce}$ is determined. Hence a condition to be satisfied for the acceleration channel length at the magnetic flux density B is determined as:

$$r_{ce} \ll L < r_{ci} \tag{14}$$

(2) Next, an condition for acceleration channel length derived from ion velocity in the acceleration channel is determined. When the plasma density increases, interionic collisions becomes more frequent, leading to an increase in ion-loss on the wall-surface of the acceleration channel. To ensure that the ions are effectively accelerated electrostatically and collisionlessly, mean free path $\lambda_{ii}$ of ions must be longer than the acceleration channel length L:

$$\lambda_{ii} \geqq L \tag{15}$$

As noted above, the average ion velocity in the acceleration channel is estimated as ½ the velocity of the acceleration channel exit, and therefore the kinetic energy per an ion is estimated as ¼ of the kinetic energy of ion at channel exit. Hence, when the condition for the acceleration channel length relating to the ion velocity is determined using the average ion temperature and the average plasma density determined in Equation (11), assuming that ¼ of the energy given to the ions by the electric field is the average energy, the following equation is obtained:

$$L \leqq \lambda_{ii} \tag{16}$$

(3) Finally, when the plasma density increases, collisions between electrons and ions become more frequent, and accordingly, electron drift in the circumferential direction is inhibited while the ions begin to rotate in the circumferential direction. In this case, not only is electrostatic acceleration of the ions inhibited, but also hall-current becomes smaller and the fundamental electromagnetic effect of hall-type electric propulsion, whereby the generation of propulsion and the maintenance of electric field maintenance are achieved through Lorentz force, becomes ineffective. The effect of electron collisions is evaluated by a hall-parameter $\omega_e\tau_e$. Here, $\omega_e$=the electron cyclotron frequency, and $\tau_e$=the average collision time for collision between an electron and an ion. When hall-parameter $\omega_e\tau_e>>1$ is not established, it is impossible to obtain a sufficient hall-current. Hence, the condition for the electromagnetic effect to take effect is $$\omega_e\tau_e>>1 \tag{17}$$

For example, when the magnetic flux density is approximately 0.05 T and the plasma density is approximately $10^{17}$ to $10^{18}$ $m^{-3}$, this condition is satisfied sufficiently. Further, the collision frequency between electrons and neutral species is smaller than the electron-ion collision frequency in the region where the ion current density and the flux density for neutral species are approximately identical, and therefore the effect of collisions with the neutral species is small.

Similarly to the case of chemical propulsion, thrust F, specific impulse $I_{sp}$ and propulsion efficiency $\eta_t$ may be used as quantities for evaluating the propulsion performance of hall-type electric propulsion serving as a type of electric propulsion.

Propulsion efficiency $\eta_t$ is estimated using the following evaluation equation:

$$\eta_t=F^2/(2m_fV_dI_d) \tag{18}$$

where $m_f$=mass flow rate, $V_d$=discharge voltage, and $I_d$=discharge current. When the thrust F is known, propulsion efficiency $\eta_t$ may be estimated from Equation (18). In addition to evaluation using Equation (18), propulsion efficiency $\eta_t$ may be evaluated by introducing three types of internal efficiency, namely acceleration efficiency $\eta_a$, propellant use efficiency $\eta_u$, and energy efficiency $\eta_E$. First, the acceleration efficiency $\eta_a$ is defined in the following manner as the ratio between the ion beam current $I_b$ and the discharge current $I_d$:

$$\eta_a=I_b/I_d \tag{19}$$

In an electrostatic acceleration-type electric propulsion such as hall-type electric propulsion or an ion-type electric propulsion, the acceleration efficiency $\eta_a$ is an important parameter indicating the operating state, but electron current is dominant in a normal discharge tube that performs glow discharge as a fluorescent lamp, and therefore the acceleration efficiency $\eta_a$ is close to 0. In hall-type electric propulsion, on the other hand, the ion flow serves as the thrust source, and therefore ion current contributes to discharge maintenance. Accordingly, acceleration efficiency $\eta_a$ does not reach 0, and maintains a certain value (approximately 0.5 when Xe is used as the propellant).

The propellant use efficiency $\eta_u$ is defined in the following manner as a ratio between the ion beam current $I_b$ and the propellant flow rate $m_f$:

$$\eta_u=MI_b/(em_f) \tag{20}$$

This is a parameter indicating the extent of which the supplied propellant is ionized to form ions and used as ion beam as a result (in the case of Xe, a value between 0.8 and 0.95 is obtained from past experiments). The energy efficiency $\eta_E$ is defined as $$\eta_E=E_m/(eV_d) \tag{21}$$

using an average energy $E_m$ of ion beam and the discharge voltage $V_d$. Note that the average energy $E_m$ of the ion beam is expressed follows using energy distribution $f(E_i)$ measured using energy analyzer:

$$E_m=\{\int f(E_i)(E_i)^{1/2}dE_i\}^2 \tag{22}$$

The energy efficiency $\eta_E$ is dependent on the potential at which ions are generated in the acceleration channel, but corresponds to approximately 0.75 at Xe.

When all ions are subjected to monovalent ionization and accelerated in the axial direction alone, the thrust F can be written as $$F=I_b\times(2ME_m)^{1/2}/e \tag{23}$$

using the average energy $E_m$ of ion beam. Accordingly, specific impulse $I_{sp}$ is defined in the following manner using gravity g:

$$I_{sp}=F/(m_fg)=I_b\times(2ME_m)^{1/2}/(em_fg) \tag{24}$$

When Equations from (19) to (21) and Equation (23) are introduced into Equation (18), the propulsion efficiency is expressed as the product of the acceleration efficiency, propellant use efficiency and energy efficiency, as shown by the following equation:

$$\eta_t=\eta_a\eta_u\eta_E \tag{25}$$

The hall-type electric propulsion of the present invention may be applied favorably not only to a plasma propulsion/accelerator (plasma engine) installed in a spacecraft, but also to a sputtering device (for micro/nano-processing), a drag/sonic-boom reduction device and plasma actuator for an aircraft, a nuclear fusion ion source technique, an overheating protection system [cooling system] for these devices, and so on.

What is claimed is:

1. A hall-type electric propulsion which obtains thrust through emitting generated plasma from an acceleration channel by electrostatic acceleration or electromagnetic acceleration, comprising:

an electromagnetic coil for magnetizing a magnetic material to generate a magnetic field is disposed on an outer side of said acceleration channel portion; and a propellant conduit for transporting a propellant is formed such that the propellant conduit is led into a plenum chamber upstream of said acceleration channel, said propellant conduit having a form that penetrates longitudinally toward a propellant introduction port along a wall surface of said acceleration channel and turns back near the propellant introduction port, wherein said plenum chamber comprises a choke portion for increasing a velocity of said propellant and an anode that forms an electric field constitutes said choke portion, thereby simultaneously solving the problem of waste heat which worsens with micronization and the problem of discharge current oscillation.

2. The hall-type electric propulsion according to claim 1, wherein said propellant conduit is wound into a spiral shape.

3. The hall-type electric propulsion according to claim 1, wherein a clearance of a gap of said choke portion decreases toward an axial downstream side.

4. The hall-type electric propulsion according to claims 1, 2, or 3, wherein said wall surface of said acceleration channel is formed by combining wall surfaces made of different heat-resistant insulators in accordance with an ionization-zone in which said plasma is generated and an acceleration-zone in which ions in said plasma are accelerated, respectively.

5. The hall-type electric propulsion according to claim 4, wherein one of said heat-resistant insulators is boron nitride (BN) or a boron nitride composite.

* * * * *